US005373772A

United States Patent [19]

Shemoul

[11] Patent Number: 5,373,772

[45] Date of Patent: Dec. 20, 1994

[54] PAGE TURNER

[76] Inventor: Elie Shemoul, P.O. Box 3, Kiryat-Gat, Israel, 82100

[21] Appl. No.: 801,513

[22] Filed: Dec. 2, 1991

[51] Int. Cl.[5] ..... G10G 7/00

[52] U.S. Cl. ..... 84/486

[58] Field of Search ..... 84/486, 489, 497, 487, 84/490, 502, 503, 504, 511

[56] References Cited

U.S. PATENT DOCUMENTS

| | | | |
|---|---|---|---|
| 1,028,270 | 6/1912 | Pfarrhofer | 84/486 |
| 1,130,108 | 3/1915 | Rodliff | 84/489 |
| 1,883,034 | 10/1932 | Snively et al. | 84/497 |
| 4,072,080 | 2/1978 | Conlin | 84/486 |

*Primary Examiner*—Michael L. Gellner
*Assistant Examiner*—P. Stanzione

[57] ABSTRACT

A page turning device placed on a music stand by a clip, a preformed set of a flat spring mechanism is fixed in an opening which is located in the center of the device. Each spring has a predetermined length; the first spring resting on the page turning device is the shortest. The second spring is longer by a predetermined length. The last spring is the longest. A narrow pocket is located at the bottom of each transparency. Each spring is connected to a transparency. To operate, each transparency is placed behind a page which is to be turned, and with the aid of a clip the transparency and the page are held together. All the springs and the transparencies, including the pages found in between, are pressed to the right. All the springs are placed together into the indentation of the movable unit in an aperture, at the right side of the device. All the springs are arranged in the unit in the following way: The shortest spring turns the first page; The longest spring turns the last page. The movable unit is connected by a cable to a gear of a toothed gear wheel located in the pedal. Every pedal depression results in a predetermined pull of a cable around the gear, causing the movable unit to move to the right on the device and to release one pressed spring which returns to its initial position, causing a page to be turned.

8 Claims, 6 Drawing Sheets

PAGE TURNER

BACKGROUND OF THE INVENTION

There is a need to turn pages in the course of playing a musical instrument or reading when one finishes playing or reading a page and would like to turn the page to proceed to the next page. The page turner will turn pages without interrupting the musical performance or reading. Musicians need both hands to play, and frequently have no free hands to play and frequently have no free hand to turn pages of the musical score. For example, a violinist or cellist who has completed playing one page of music has to turn the page while holding the bow, interrupting the tempo of the music. The page turner will help simplify the procedure of page turning. One touch of the foot of the pedal is enough and the page will turn automatically. The prior art does not disclose a device that turns pages without using electricity, and which is easy to use on a music stand or any other surface. The prior art does not disclose a page turner that functions by using a flat spring mechanism assembly.

SUMMARY OF THE INVENTION

This instrument according to the invention will solve a big problem for musicians who must turn pages in the middle of a concert, while performing. Furthermore this instrument will aid the handicapped who have limited use of their hands. The following paragraphs describes in further detail the procedure and function of my invention, a spring assembly page turner.

BRIEF DESCRIPTION OF THE DRAWINGS

The page turner is composed of:

The Instrument (FIG. 1); Spring assembly (FIG. 2);

Figure 3:
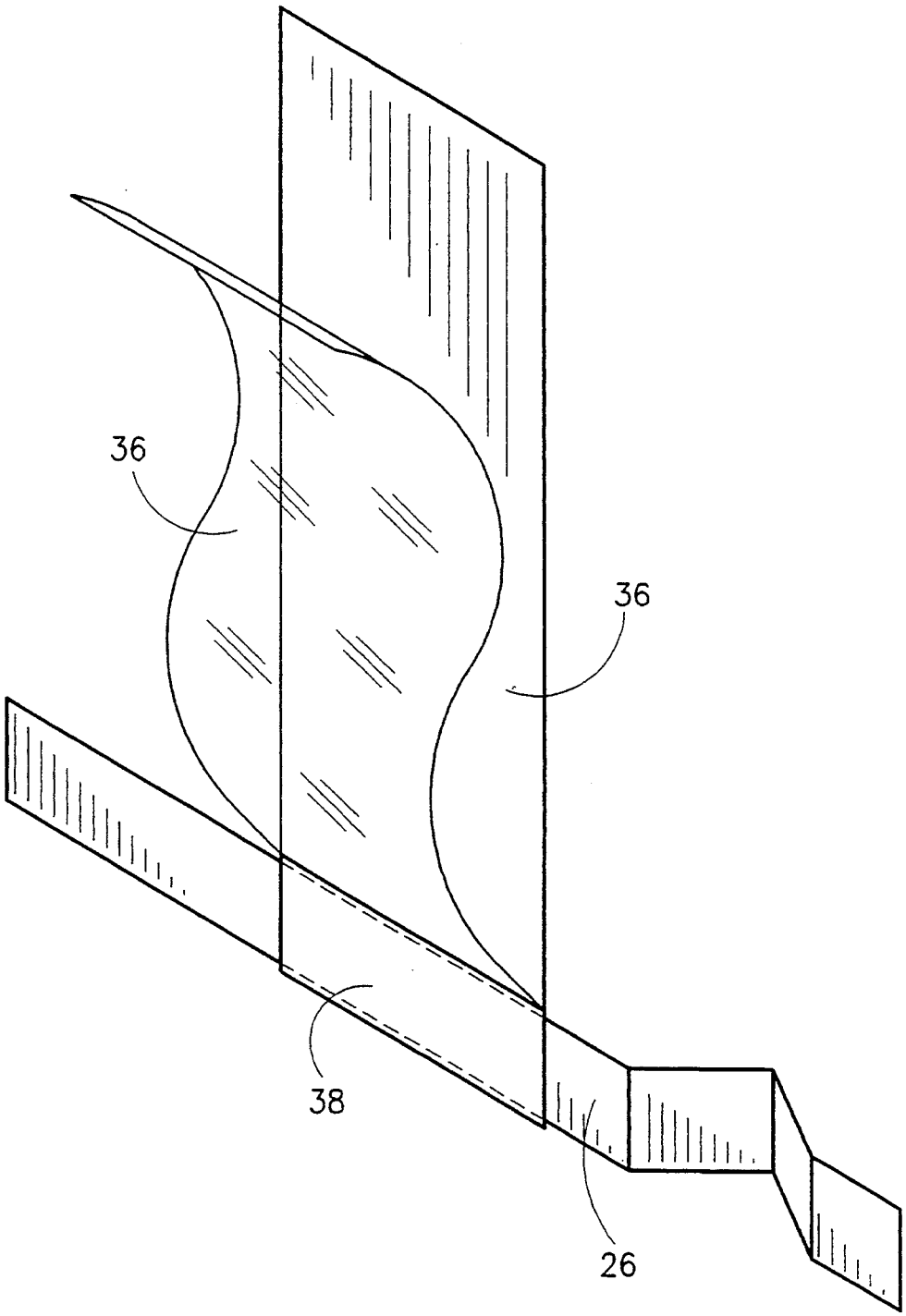
Figure 4:
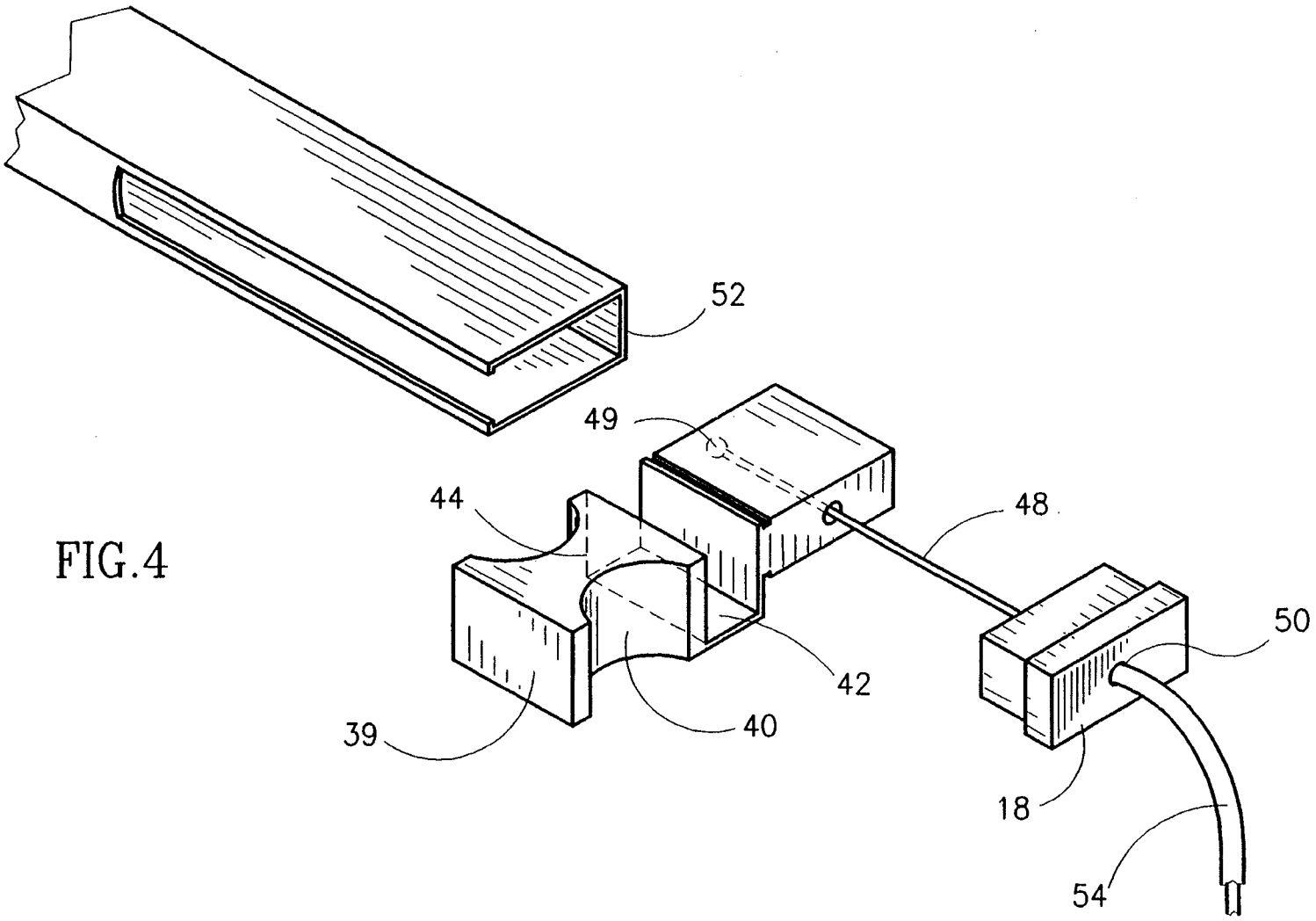
Figure 5:
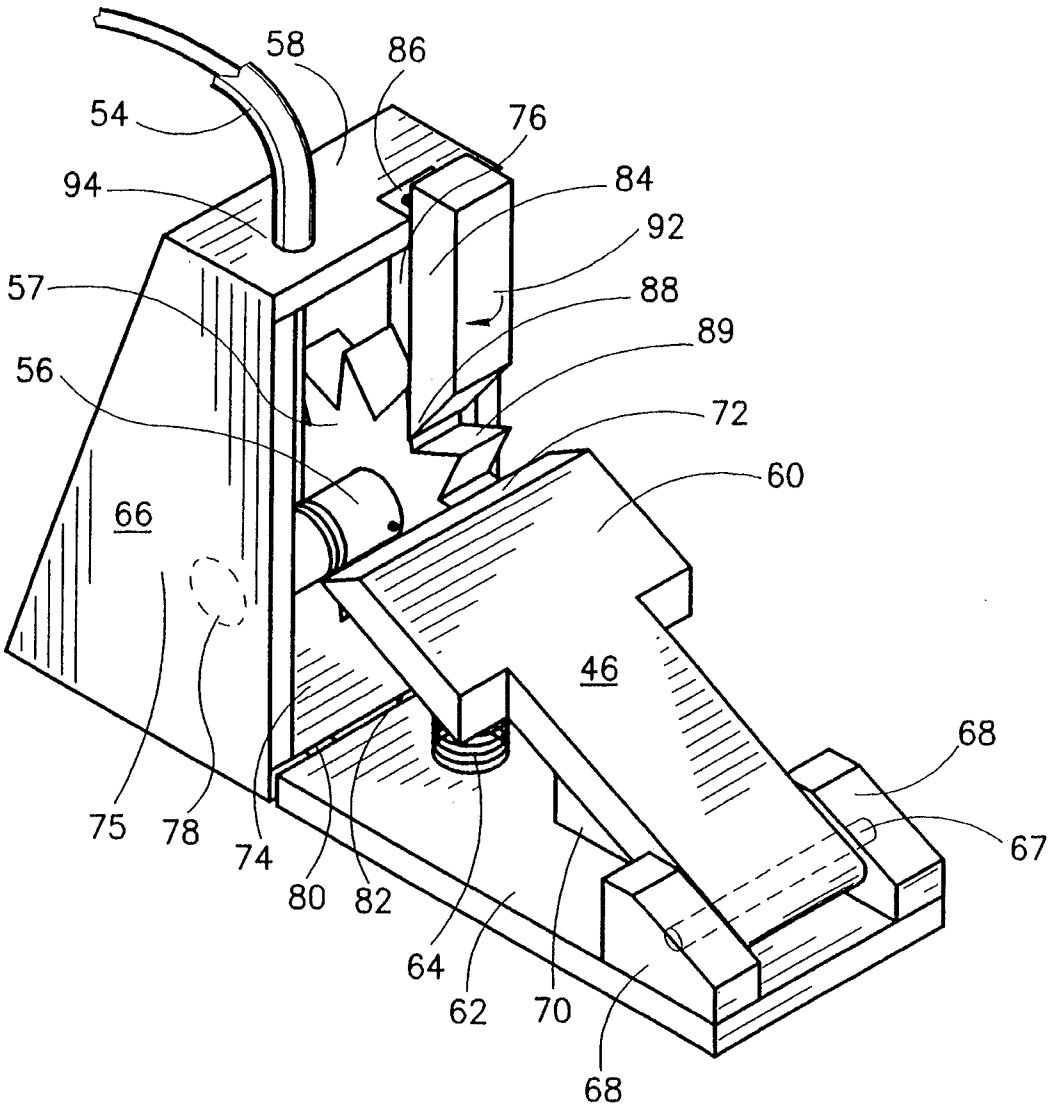
Figure 6:
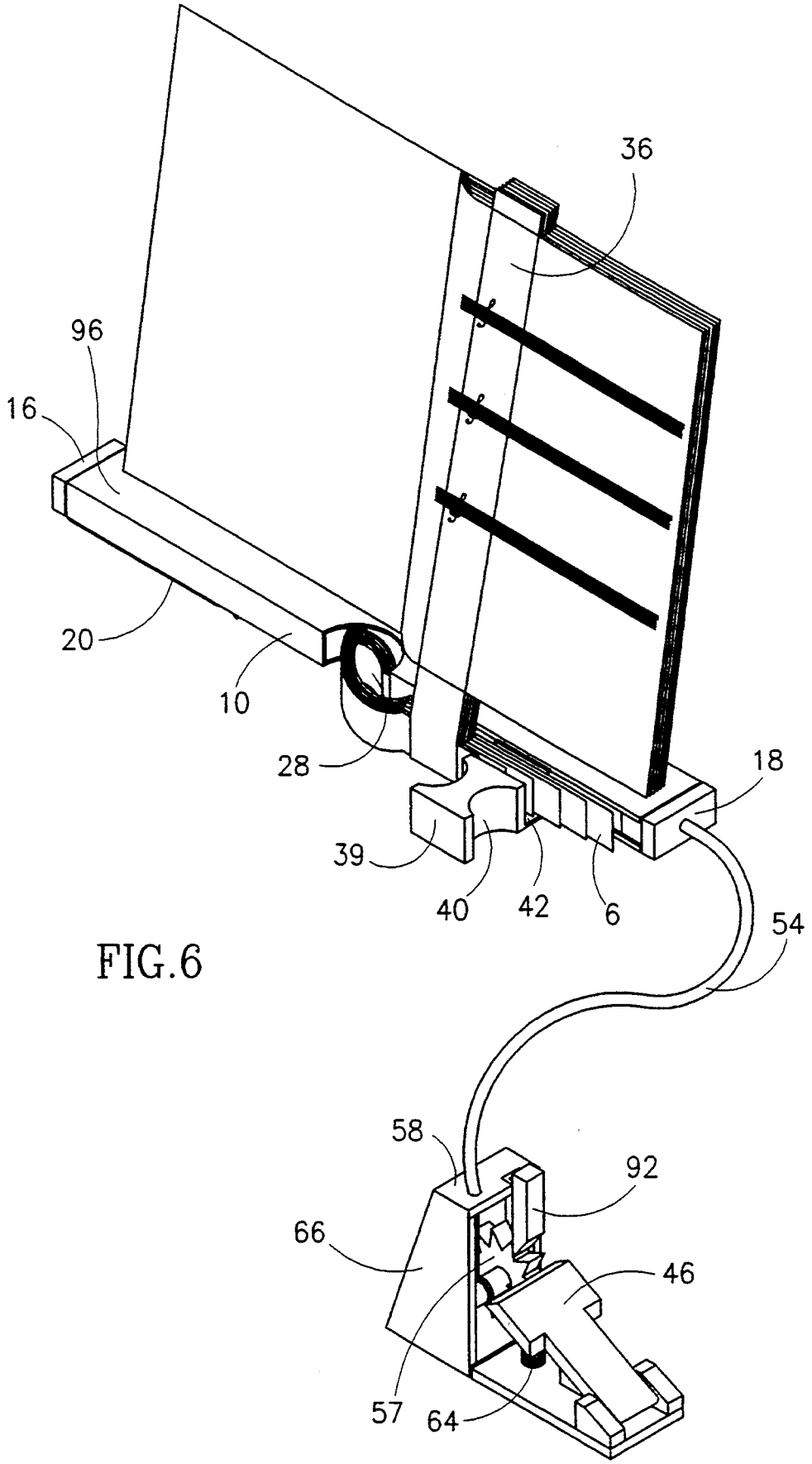

The transparencies (FIG. 3);

The movable unit, the Cable and Sleeve (FIG. 4);

The Pedal (FIG. 5); and The Overall View (FIG. 6)

DETAILED DESCRIPTION OF A PREFERRED EMBODIMENT

I. The Instrument, and Spring Assembly.

A. The instrument

Figure 1:
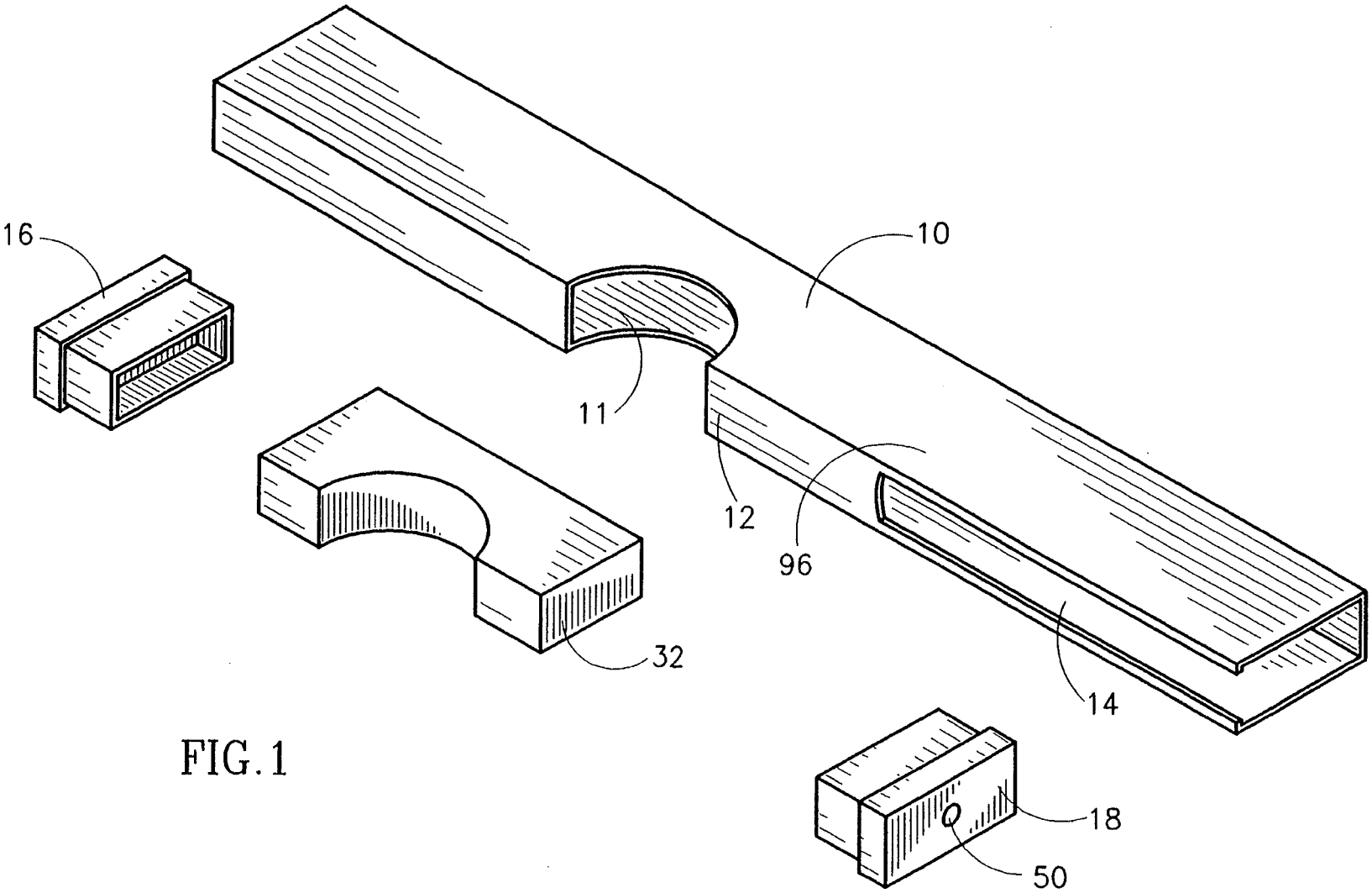

The instrument 10, is a page turning device placed horizontally on a music stand, piano or where needed. On the front side of the instrument 10, there is an opening 11 used for resting the springs (FIG. 1) and holding them in area 12 (FIG. 1).

Figure 2:
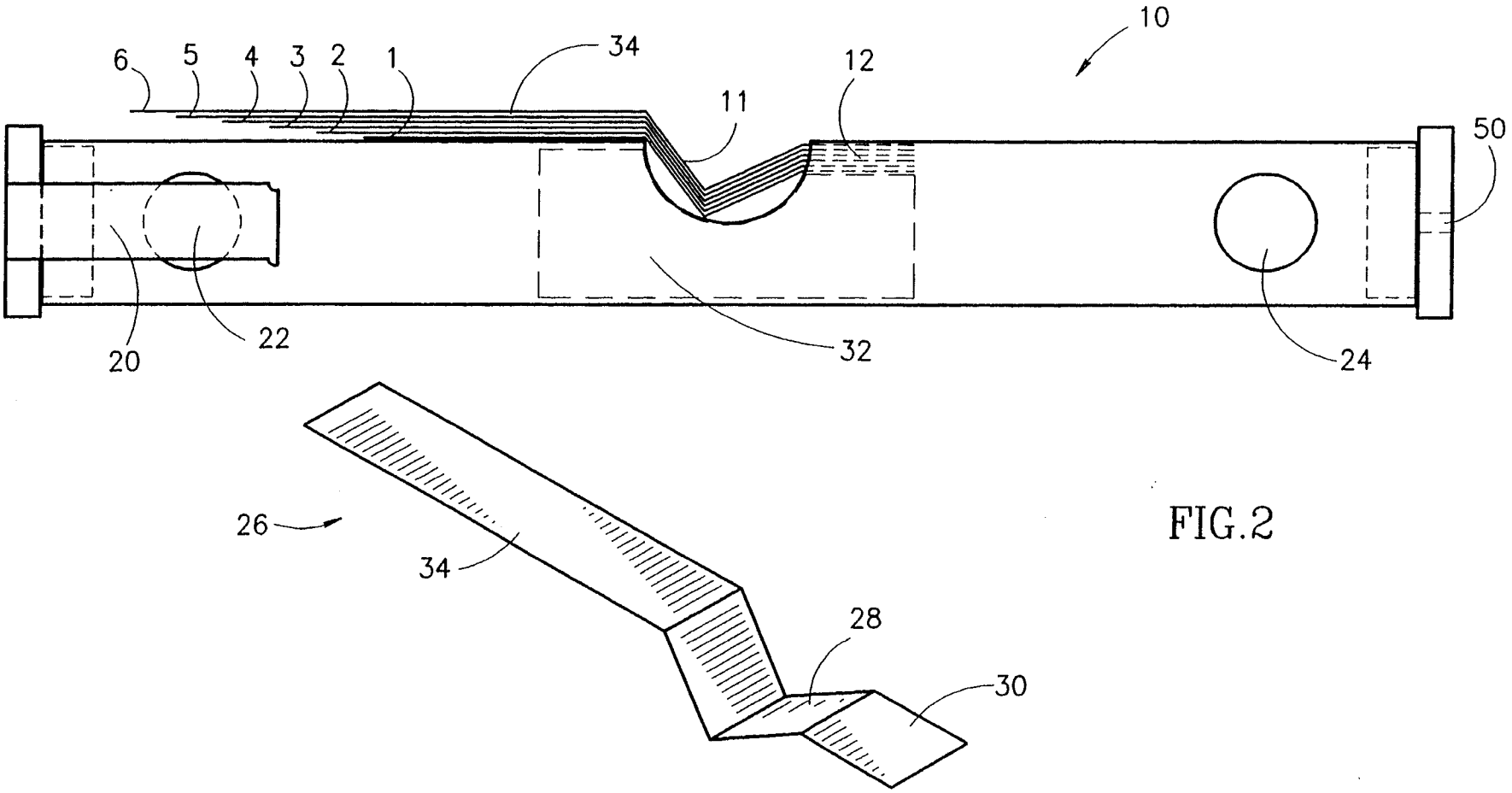

To the right of the opening there is a horizontal aperture 14 in the instrument 10 (FIG. 1) which ends before the opening 11 (FIG. 1) in this hollow aperture 14 the unit can move freely horizontally, (a detailed explanation will follow). On both ends of the instrument there are closing profile blocks 16, 18 (FIG. 1), on the bottom of the instrument 10, a clip 20 is attached to secure it to a music stand or other surface (FIG. 2). Base knobs 22, 24, are secured on the bottom of the instrument 10 (FIG. 2) for two purposes: a. To secure the instrument 10; b. To raise the instrument 10 to free horizontal movement of the unit 39. A detailed explanation follows.

B. The Spring Assembly

The main purpose of using the spring assembly is to utilize the spring's energy for turning pages. After the spring is pressed in a specific way it will automatically return to its original position, due to its natural characteristics. In this case, it will make a 180 degree return movement.

The number of springs in an instrument 10 will be equal to the number of pages to be turned. All the springs are bent in relation to each other into a certain shape. In the preferred embodiment the springs 26 are bent in the shape as shown in FIG. 2.

The triangular area 28 (FIG. 2) of the bent springs 26 is placed in the opening 11 (FIG. 1, FIG. 2).

Area 30 (FIG. 2) of the bent springs 26, is used for catching and gathering the springs. Area 30 of all the springs 26 is inserted into the side of the opening 12 (FIG. 2) of the instrument 10 and are held there by an inserted adjusted stopper 32 (FIG. 1) which fits the opening 11 (FIG. 1 FIG. 2).

Area 34 (FIG. 2) of the bent spring is used for sliding and attaching P.V.C. transparencies 36 (FIG. 3) used for turning the pages. The length of area 34 (FIG. 2) of each spring is different: The closest spring, spring no. 1, resting on the instrument 10 is the shortest of all the springs 26. It will turn page no. 1.

The next spring 26 is spring no. 2. It is longer than spring no. 1 by a predetermined length. It will turn page no. 2.

The last spring no. 6 is the longest of all the springs 26 in the instrument 10 (FIG. 2) and it will turn the last page.

Each spring 26 is attached to a double P.V.C. transparency 36 (FIG. 3) the spring 26 is inserted, into the spring-pocket 38 at the bottom of the double P.V.C. transparency (FIG. 3).

II. The Movable Unit

The movable unit 39 (FIG. 4) is made up of three components:

a. A holding knob 40;

b. The indentation 42; and c. A spring releaser 44.

a. A holding knob

The external part of the movable unit 39 is shaped like a knob 40 for moving the unit 39 horizontally (FIG. 4) and for relocating the unit 39 for additional use.

b. The indentation

The indentation part 42 of the movable unit holds the springs 26 until the are released. All the springs 26 are pressed together and placed into the indentation 42 in the movable unit (FIG. 4). The indentation 42 is made deep enough so that the springs 26 rest securely and horizontally at 180 degrees.

c. The Spring Releaser

The movable unit 39 moves a determined distance horizontally in the aperture via an attached cable. After pressing the pedal the shortest spring 26 will be released first via spring releaser 44. The rest of the springs will be held in the indentation 42 and so on. Each movement of the movable unit 39 activated by the pedal 46 (FIG. 5) will release one spring 26 and the page that is attached to a P.V.C. transparency 36.

III. The Cable and Sleeve

The cable 48 is attached firmly at point 49 to the movable unit 39 (FIG. 4) via a hole 50 in the closing profile block 18 (FIG. 1) the closing profile block 18 is located at the side 52 (FIG. 4) of the instrument 10. Therefore when the cable 48 is moved in one direction the attached movable unit 39 in the aperture 14 will also move.

The other end of the cable is inserted through a sleeve 54 (FIG. 4) and fixed firmly to the axle 56 of the gear wheel 57 via the pedal's top unit 58 (FIG. 5). The sleeve 54 is flexible, similar to those used in bicycle hand-brakes. It is used as a holding force between the instrument 10 and the pedal 46, so that the cable will move the unit when the axle 56 of the gear wheel 57 is turned.

The sleeve 54 is firmly fixed of both ends: (1) to one of the closing profile blocks 18 at the edge of the instrument 10 (FIG. 4) and; (2) to the top unit 58 of the pedal 46 (FIG. 5).

IV. The Pedal

The role of the pedal 46 is to pull the cable 48 in one direction by a predetermined distance. Therefore, the movable unit 39 which holds the springs moves a certain distance and as a result, it releases one spring automatically, a page is turned.

The pedal 46 consists of four parts:

a. the footrest 60 (FIG. 5);

b. the base 62;

c. the spring 64; and d. the gear-box unit 66.

The footrest, base and spring:

The footrest 60 and the base 62 are connected at both ends by a hinge, 67 going through levers 68 on the upper ends of the base 62 (FIG. 5). A coil spring 64 whose length is predetermined is firmly fixed between the footrest 60 and the base 62 to limit the footrest's upward motion. (FIG. 5).

Furthermore, a suitable stopper 70 is fixed between the base 62 and the footrest 60 on the top side of the base, 62 to limit the footrest's downward motion (FIG. 5).

The top anterior part 72 of the footrest is in line with the toothed gear wheel 57 (FIG. 5).

The Gear Box Unit 66, is composed of four parts:

1. The gear box top 58;
2. The gear box bottom 74;
3. The gear box walls 75,76; and
4. The toothed gear wheel 57 and the axle 56.

A hole 78 is drilled halfway through the interior side of both walls 75–76 of the gear box unit 66 in a suitable place. The axle 56 of the toothed gear wheel 57 rests in both holes 78 and turns freely, forwards and backwards (FIG. 5).

The gear box top 58 and the gear box bottom 74 are joined by both the gear box walls, 75–76 forming the entire gear box unit 66. (FIG. 5).

A hinge 80–82 is joined under both the gear box bottom 74 and the base 62 so that the toothed gear wheel 57 is aligned with the footrest's anterior part 72 (FIG. 5).

A one-way stopper 84 is attached by a hinge 86 on the gear box top 58 directly above the toothed gear wheel 57. The stopper 84 is attached to the hinge 86 unequally so that most of the weight of the stopper 84 is on its bottom half. Therefore, due to the law of gravity and the weight of the stopper 84 it drops downward immediately, preventing backward motion of gear wheel 57 (FIG. 5).

Due to the equal angels of the ends 88, of the stopper 84, and the angle of the gear's teeth 89 (90 degrees) (FIG. 5), each tooth 89 of the gear wheel 57 will meet with the stopper 84 halting the rotation of the toothed gear wheel 57. The stopper 84 can be prevented from functioning by turning it aside (arrow 92) (FIG. 5). Therefore, without the stopper 84, the gear wheel 57 will turn freely backward and forwards.

By depressing the footrest 60 its anterior part 72 is pushed forward, engaging the gear wheel 57 one tooth at a time. At the same time, the one-way stopper 84 is pushed upward and lets the toothed gear wheel 57 turn freely in that direction. Then the stopper 84 drops into the next tooth 89. The toothed gear wheel 57 cannot turn backwards with the stopper 84 in place. The stopper 84 securely fits into one of the teeth 89 for the wheel and resists backward motion. The energy of the spring 64 (FIG. 5) pushes the footrest 60 upward causing the entire gear box unit 66 to move backwards freely due to the hinges 80–82, enabling the footrest 60 to move to the next position of the gear wheel 57.

The Sleeve and Connection

The sleeve 54 leads the cable 48 to the hole 94 (FIG. 5) in the gear box top unit 58, and is permanently secured there. The cable 48 is threaded through the hole 94, and is permanently fixed at an angle to the axle 56 of the toothed gear wheel 57. The result is an equal pull of the cable 48 by the axle 56, when the footrest 60 is pressed (FIG. 5). The base knobs (not shown) are placed under the pedal, resulting in a smooth and quiet action of the pedal, and preventing sliding of the pedal.

Toothed Gear Wheel and Axle

Due to the toothed gear wheel's angles, it is possible to do two acts simultaneously.

1. The toothed gear wheel's angles are designed so that the stopper can fit into each tooth 89 before or after the action of the footrest 60 is completed.

2. In this case, the stopper 84 rests on the new tooth 89 before the footrest 60 completes its downward stroke.

3. The axle 56 and the toothed gear wheel 57 function together as one unit. The diameter of the axle 56 is calculated according to the desired pulling distance of the movable unit 39 of the instrument 10. The relationship between the axle's diameter and the toothed gear wheel 57 is in relation to the desired pulling distance of the movable unit 39 of the instrument 10.

OPERATING INSTRUCTIONS (FIG. 6)

1. Slide the clip 20 of the instrument onto the music stand (FIG. 2).

2. Put the pedal 46 on a flat surface so that the knobs found under the pedal are flat and securely on the surface, (usually the floor near the user).

3. Neutralize the gear box stopper 84 by turning it aside so that the gear wheel 57 turns freely (FIG. 5).

4. Place the movable unit 39 in the aperture 14 of the instrument 10 at the farthest end closest to the opening 11.

5. Turn the stopper 84 to a functioning position by placing it on one tooth 89 of the toothed gear wheel 57 (FIG. 5).

6. Remove all the flexible P.V.C. transparencies 36 from the page turner so that a book or a music sheet can be freely placed on the page turner surface 96 (FIG. 1).

7. Open the book and place on the page, the first P.V.C. transparency 36 attached to the spring 26 (FIG. 3).

8. Turn the first page to be turned on the previous P.V.C. transparency 36 and cover it with the second P.V.C. transparency 36 that is attached to the first spring 26 (FIG. 3).

9. Put the top P.V.C. transparency 36 attached to the second spring 26 (FIG. 2) on the previous P.V.C. transparency 36, cover it with the next desired page to be turned, and cover the page with the other P.V.C. transparency 36 attached to the second spring 26 etc. until the last spring 26. Hint: the P.V.C. transparent sheet can be clipped to the pages with a paper clip for extra security.

10. Hold all the pages and springs connected to the P.V.C. transparencies 36 and bend them all securely into the indentation 42 of the movable unit 39 (FIG. 4). Align all the pages and make sure that the movable unit 39 is at the farthest end of the aperture 14 (FIG. 1).

11. Press the footrest 60 of the pedal 46, the result is an immediate release of the page.

What is claimed:

1. A page turning device comprising:

an elongated housing having formed therein an aperture extending longitudinally along a portion of the length thereof;

a movable unit slidably engaged within said aperture;

spring assembly means comprising a plurality of flat springs fixedly seated at a first end within said housing, a second end of each of said flat springs releasably engaging said movable unit in a bent position;

a plurality of elements being interleaved with individual ones of a plurality of pages for turning, each of said plurality of interleaved elements being connected to one of said flat springs; and pedal means connected to said movable unit such that when depressed, said movable unit slides within said aperture over a predetermined length, to release said second ends of said flat springs from said bent position, and turn said pages.

2. The device of claim 1 wherein said movable unit moves in said aperture or elsewhere and uses the spring's energy to turn pages.

3. The device of claim 1 wherein said movable unit has formed therein a slot for engaging said flat spring second ends.

4. The device of claim 1 wherein said elements comprise transparent material.

5. The device of claim 1 wherein said elements comprise translucent material.

6. The device of claim 1 wherein said predetermined length is sufficient to release an individual one of said flat springs.

7. The device of claim 1 wherein said pedal means comprises a gear wheel mounted on an axle having a cable wound thereon, said cable being connected to said movable unit and causing it to slide in said aperture upon pedal depression.

8. The device of claim 7 wherein said pedal depression is repeatable.

* * * * *